US008371582B2

(12) United States Patent
Matsuno et al.

(10) Patent No.: US 8,371,582 B2
(45) Date of Patent: Feb. 12, 2013

(54) IMAGE FORMING APPARATUS

(75) Inventors: Takuji Matsuno, Ichinomiya (JP); Kazuyoshi Minaminaka, Suzuka (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 12/732,274

(22) Filed: Mar. 26, 2010

(65) Prior Publication Data

US 2010/0327510 A1 Dec. 30, 2010

(30) Foreign Application Priority Data

Jun. 29, 2009 (JP) ..... 2009-153434
Jan. 28, 2010 (JP) ..... 2010-016276

(51) Int. Cl.
*B65H 39/10* (2006.01)
*B65H 29/00* (2006.01)

(52) U.S. Cl. ..... 271/302; 271/184

(58) Field of Classification Search ..... 271/302, 271/303, 184–186
See application file for complete search history.

(56) References Cited

U.S. PATENT DOCUMENTS

| | | | | |
|---|---|---|---|---|
| 5,280,331 | A | 1/1994 | Namiki | |
| 5,708,954 | A * | 1/1998 | Ando et al. | 399/402 |
| 6,177,977 | B1 | 1/2001 | Tanaka et al. | |
| 6,185,381 | B1 | 2/2001 | Nakahara et al. | |
| 6,332,611 | B1 | 12/2001 | Tomita | |
| 6,789,794 | B2 * | 9/2004 | Miyazawa | 271/184 |
| 7,437,096 | B2 | 10/2008 | Ito et al. | |
| 7,437,109 | B2 | 10/2008 | Andoh | |
| 7,448,621 | B2 * | 11/2008 | Yasumoto | 271/264 |
| 7,555,239 | B2 | 6/2009 | Ito et al. | |
| 7,699,312 | B2 * | 4/2010 | Fukuda et al. | 271/303 |
| 7,789,388 | B2 * | 9/2010 | Matsubara et al. | 271/301 |
| 7,862,041 | B2 * | 1/2011 | Taniguchi | 271/303 |
| 2002/0039508 | A1 | 4/2002 | Tsusaka et al. | |
| 2005/0189712 | A1 * | 9/2005 | Carter et al. | 271/303 |

(Continued)

FOREIGN PATENT DOCUMENTS

| | | |
|---|---|---|
| JP | 03-211161 | 9/1991 |
| JP | 04-028677 | 1/1992 |

(Continued)

OTHER PUBLICATIONS

JP Office Action dtd Apr. 26 2011, JP Appln. 2009-153434, English translation.

(Continued)

*Primary Examiner* — Patrick Cicchino
(74) *Attorney, Agent, or Firm* — Banner & Witcoff, Ltd.

(57) ABSTRACT

An image forming apparatus includes: a main body having a side wall in which an opening is formed; a cover for opening and closing the opening; and a guide member for guiding a printed recording sheet, arranged in a position facing to the opening. The guide member is pivotally supported at its lower end portion on the main body. When the cover is being opened and the guide member is pivoted around its lower end portion as a pivot axis so that an upper end portion of the guide member is tilted toward the opened cover and into a lying-back position, a second sheet-output passage is formed which extends from the image forming unit toward the opened cover through the opening. The guide member is movable to a position away from the opened cover when it is in the lying-back position.

11 Claims, 13 Drawing Sheets

U.S. PATENT DOCUMENTS

| | | | | |
|---|---|---|---|---|
| 2005/0254872 | A1* | 11/2005 | Nonaka et al. | 399/401 |
| 2006/0008294 | A1 | 1/2006 | Ito et al. | |
| 2006/0159488 | A1 | 7/2006 | Iketani | |
| 2006/0193666 | A1 | 8/2006 | Tomatsu | |
| 2006/0280530 | A1 | 12/2006 | Andoh | |
| 2008/0315515 | A1 | 12/2008 | Sunohara | |
| 2009/0022515 | A1 | 1/2009 | Ito et al. | |
| 2009/0297243 | A1* | 12/2009 | Matsuno | 399/405 |
| 2010/0187756 | A1* | 7/2010 | Fukuda et al. | 271/303 |

FOREIGN PATENT DOCUMENTS

| | | | |
|---|---|---|---|
| JP | 04-199066 | | 7/1992 |
| JP | 05-051160 | | 3/1993 |
| JP | 05-193139 | | 8/1993 |
| JP | 06-156846 | | 6/1994 |
| JP | 08-188344 | A | 7/1996 |
| JP | 10-072174 | | 3/1998 |
| JP | 10-148973 | A | 6/1998 |
| JP | 10-330008 | | 12/1998 |
| JP | 2000-191244 | | 7/2000 |
| JP | 2000-231321 | A | 8/2000 |
| JP | 2000-238959 | | 9/2000 |
| JP | 2001-039602 | | 2/2001 |
| JP | 2001-106426 | | 4/2001 |
| JP | 2001-109330 | | 4/2001 |
| JP | 2001-114462 | | 4/2001 |
| JP | 2001-139219 | | 5/2001 |
| JP | 2001-171884 | | 6/2001 |
| JP | 2001-183883 | | 7/2001 |
| JP | 2001-183954 | | 7/2001 |
| JP | 2001-277674 | | 10/2001 |
| JP | 2001-305918 | | 11/2001 |
| JP | 2002-104707 | | 4/2002 |
| JP | 2002-145504 | | 5/2002 |
| JP | 2002-274725 | | 9/2002 |
| JP | 2003-171062 | | 6/2003 |
| JP | 2003-295733 | A | 10/2003 |
| JP | 2004-109165 | | 4/2004 |
| JP | 2004-109623 | | 4/2004 |
| JP | 2004-331387 | | 11/2004 |
| JP | 2005-029285 | | 2/2005 |
| JP | 2005-219825 | | 8/2005 |
| JP | 2005-219860 | | 8/2005 |
| JP | 2005-320150 | | 11/2005 |
| JP | 2005-338561 | | 12/2005 |
| JP | 2006-053508 | A | 2/2006 |
| JP | 2006-076667 | | 3/2006 |
| JP | 2006-201335 | | 8/2006 |
| JP | 2006-240765 | | 9/2006 |
| JP | 2006-330172 | | 12/2006 |
| JP | 2006-349808 | A | 12/2006 |
| JP | 2007-033897 | A | 2/2007 |
| JP | 2007-254111 | | 10/2007 |
| JP | 2008-052182 | A | 3/2008 |
| JP | 2008-052184 | A | 3/2008 |
| JP | 2008-151850 | A | 7/2008 |
| JP | 2009-015126 | A | 1/2009 |
| JP | 2009003352 | | 1/2009 |

OTHER PUBLICATIONS

JP Decision of Patent Grant dtd Jul. 31, 2012, JP Appln. 2010-016276, English translation.

* cited by examiner

IMAGE FORMING APPARATUS

CROSS-REFERENCE TO RELATED APPLICATION(S)

This application claims priority from Japanese Patent Application No. 2009-153434 filed on Jun. 29, 2009 and Japanese Patent Application No. 2010-016276 filed on Jan. 28, 2010, the disclosures of which are incorporated herein by reference in its entirety.

BACKGROUND OF THE INVENTION

1. Field of the Invention

The present invention relates to an image forming apparatus provided with a cover to open and close an opening that is formed in a side wall of a main body, wherein when the cover is in an open position, ejected sheets of paper can be stacked on the opened cover.

2. Description of Related Art

A conventional image forming apparatus known in the art includes an image forming unit configured to form an image on a sheet of paper (recording sheet), a rear cover configured to open and close an opening formed in a rear wall of the main body, and a guide member arranged between the image forming unit and the opening and configured to guide the recording sheet ejected from the image forming unit to a sheet output tray formed on an upper surface of the main body. In this image forming apparatus, a lower end of the guide member is pivotally supported on the main body, and an upper end of the guide member is connected to the rear cover.

According to this conventional image forming apparatus, when the rear cover is tilted back, the guide member connected to the rear cover is also tilted back to form a part of a tray. Therefore, the recording sheet ejected from the image forming unit can be output through the opening onto the rear cover when the rear cover is in the tilted-back position.

However, in this conventional image forming apparatus, when the rear cover is in the tilted-back position, a gap is formed between the rear cover and the upper end of the guide member and a recording sheet ejected onto the rear cover may disadvantageously goes into the image forming unit. Further, if a recording sheet goes into the image forming unit from the gap and gets jammed between the rear cover and the guide member, it is difficult to fix a paper jam because the upper end of the guide member is connected to the rear cover. In other words, a trouble about a paper jam between the rear cover and the guide member may not be overcome by the conventional image forming apparatus.

In view of the above, the present invention seeks to provide an image forming apparatus, which can overcome a trouble about a paper jam between the rear cover and the guide member at the tilted-back position of the rear cover.

SUMMARY OF THE INVENTION

According to a first aspect of the present invention, an image forming apparatus comprises: a main body having a side wall in which an opening is formed; a cover pivotally supported at its lower portion on the main body and configured to open and close the opening; an image forming unit configured to form an image on a recording sheet; a first sheet-output passage configured to guide the recording sheet, which is conveyed from the image forming unit toward the opening along a recording sheet conveyance direction, to a sheet-output tray positioned outside the main body; a return passage connected to the first sheet-output passage and configured to guide the recording sheet from the first sheet-output passage back to a position upstream from the image forming unit as viewed in the recording sheet conveyance direction; and a guide member for guiding the recording sheet, arranged between the first sheet-output passage and the return passage and facing to the opening; wherein the guide member is pivotally supported at its lower end portion on the main body; wherein when the cover is being opened and the guide member is pivoted around the lower end portion as a pivot axis so that an upper end portion of the guide member is tilted toward the opened cover and into a lying-back position, a second sheet-output passage is formed which extends from the image forming unit toward the opened cover through the opening; and wherein the guide member is configured to be movable to a position away from the opened cover when it is in the lying-back position.

According to a second aspect of the present invention, an image forming apparatus comprises: a main body having a side wall in which an opening is formed; a cover pivotally supported at its lower portion on the main body and configured to open and close the opening; an image forming unit configured to form an image on a recording sheet; a first sheet-output passage configured to guide the recording sheet, which is conveyed from the image forming unit toward the opening along a recording sheet conveyance direction, to a sheet-output tray positioned outside the main body; a return passage connected to the first sheet-output passage and configured to guide the recording sheet from the first sheet-output passage back to a position upstream from the image forming unit as viewed in the recording sheet conveyance direction; and a guide member for guiding the recording sheet, arranged between the first sheet-output passage and the return passage and facing to the opening; wherein the guide member is pivotally supported at its lower end portion on the main body; wherein when the cover is being opened and the guide member is pivoted around the lower end portion as a pivot axis so that an upper end portion of the guide member is tilted toward the opened cover and into a lying-back position, a second sheet-output passage is formed which extends from the image forming unit toward the opened cover through the opening; and wherein the guide member is configured such that the upper end portion of the guide member is in contact with the opened cover when it is in the lying-back position.

BRIEF DESCRIPTION OF THE DRAWINGS

To better understand the claimed invention, and to show how the same may be carried into effect, reference will now be made, by way of example only, to the accompanying drawings, in which:

DETAILED DESCRIPTION OF THE EXEMPLARY EMBODIMENT

A detailed description will be given of an exemplary embodiment of the present invention with reference to the drawings. In the following description, an overall configuration of a color printer as an example of an image forming apparatus will be described at first. Then, a characteristic configuration according to the present invention will be described in detail.

Figure 1:
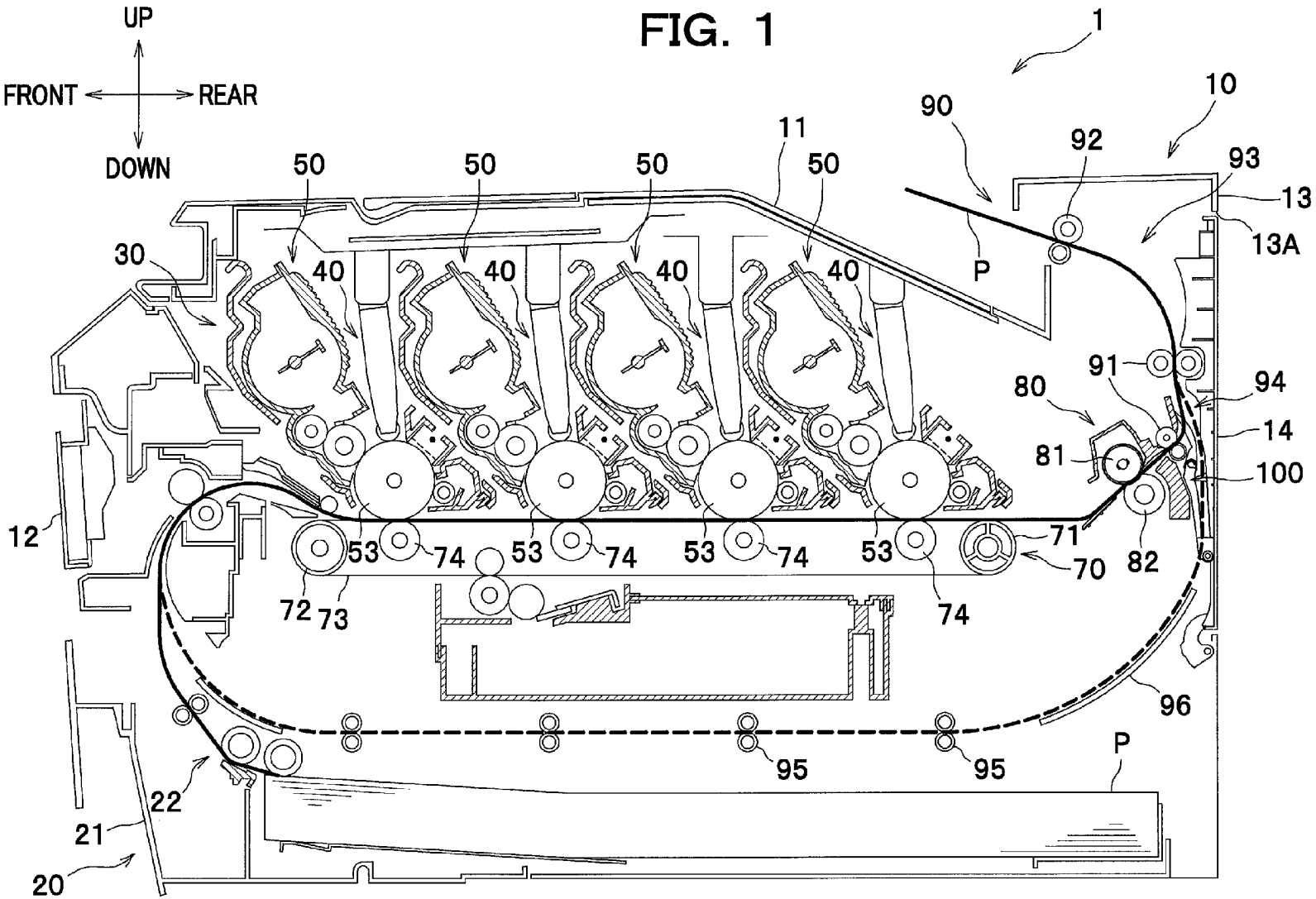
FIG. 1 is a sectional view of a color printer according to one embodiment of the present invention.

In the following description, unless otherwise stated, directions of a color printer refer to the directions as seen from a user facing to the color printer during its use. To be more specific, referring to FIG. 1, a left-side direction and a right-side direction of the drawing sheet are referred to as a "front side" and a "rear side" of the color printer, respectively. Also, a direction away from a viewer of FIG. 1 is referred to as a "left side", and a direction toward the viewer of FIG. 1 as a "right side". An upward and downward direction in FIG. 1 is referred to as a "vertical direction" or an "upward and downward direction" as it is.

As seen in FIG. 1, a color printer 1 has a main body 10. In the main body 10, the color printer 1 includes: a sheet feeding unit 20 configured to feed a sheet of paper P (hereinafter simply referred to as a "sheet" P) as an example of a recording sheet; an image forming unit 30 configured to form an image on the sheet P supplied from the sheet feeding unit 20; and a sheet output unit 90 configured to discharge the sheet P having the image thereon from the main body 10.

The sheet feeding unit 20 is arranged at a lower part of the main body 10, and mainly includes a sheet feed tray 21 configured to be detachably attached to the main body 10, and a sheet feed mechanism 22 configured to convey a sheet P from the sheet feed tray 21 to the image forming unit 30. In the sheet feeding unit 20, the sheet feed mechanism 22 separates a stack of sheets P stored in the sheet feed tray 21 and feeds a sheet P on one-by-one basis to the image forming unit 30.

The image forming unit 30 mainly includes four LED units 40, four process cartridges 50, a transfer unit 70, and a fixing device 80.

The LED unit 40 has a plurality of LEDs in order to expose a photoconductor drum 53 to be described later to light.

The process cartridge 50 includes a photoconductor drum 53 arranged opposite to an upper surface of a belt 73 to be described later, a known charger (reference numeral omitted), a known developing roller (reference numeral omitted), and a known toner storage chamber (reference numeral omitted).

The transfer unit 70 is positioned between the sheet feeding unit 20 and the process cartridges 50, and mainly includes a drive roller 71, a driven roller 72, the belt 73, and transfer rollers 74.

The fixing device 80 includes a heating roller 81, and a pressure roller 82 positioned opposite to the heating roller 81 and pressed against the heating roller 81.

According to the image forming unit 30 as configured above, the surface of each photoconductor drum 53 is uniformly charged by the corresponding charger, and is exposed to light by the LED unit 40. Therefore, the electric potential of the exposed area lowers so that an electrostatic latent image associated with an image data is formed on the surface of the photoconductor drum 53. Thereafter, when toner is supplied from the developing roller onto the electrostatic latent image, a toner image is carried on the photoconductor drum 53.

Next, a sheet P supplied on the belt 73 passes between the photoconductor drums 53 and the corresponding transfer rollers 74, during which toner images (images) formed on the plurality of photoconductor drums 53 are transferred onto the sheet P. Thereafter, when the sheet P passes between the heating roller 81 and the pressure roller 82, the toner image that has been transferred onto the sheet p is thermally fixed.

The sheet output unit 90 mainly includes a plural pairs of conveyor rollers 91, and a pair of sheet output rollers 92. These rollers 91, 92, guides, and the like define a first sheet-output passage 93 along which a printed sheet P (sheet P having a toner image fixed thereon) from the image forming unit 30 is guided to a sheet-output tray 11 positioned outside the main body 10. To be more specific, in this first sheet-output passage 93, a sheet P, which is conveyed from the fixing device 80 toward an opening 13A (to be described later) provided at the rear side of the main body 10, is guided to the sheet-output tray 11 positioned on the upper surface of the main body 10 using a guide member 100 to be described later and the like.

A return passage 94 is connected to the first sheet-output passage 93. The return passage 94 is configured to guide the sheet P from the first sheet-output passage 93 back to a position upstream from the image forming unit 30 as viewed in a sheet conveyance direction. The return passage 94 is defined by a plurality of reverse conveyance rollers 95, a guide 96, and the like.

During single-sided printing, the sheet P ejected from the fixing device 80 is conveyed in the sheet output unit 90 by the plural pairs of conveyance rollers 91 and the pair of sheet-output rollers 92, and then ejected onto the sheet-output tray 11. Meanwhile, during double-sided printing, the sheet P that has been printed on one side is ejected halfway through by the sheet-output rollers 92 onto the sheet-output tray 11, and thereafter conveyed to the return passage 94 by the reverse rotation of the sheet-output rollers 92 (switch back). The sheet P is then resupplied upside down to a position upstream from the image forming unit 30.

Figure 2:
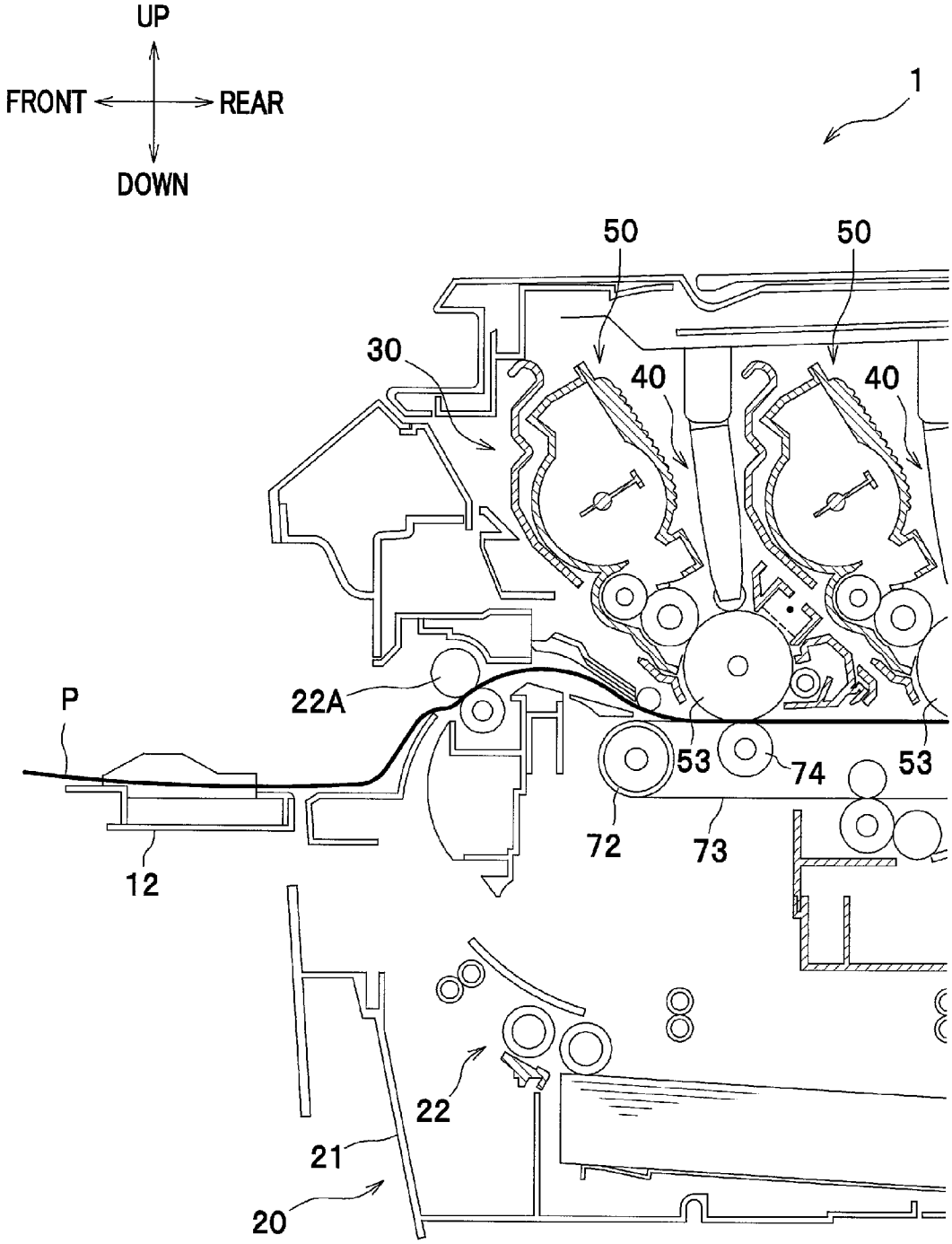
FIG. 2 is an enlarged sectional view showing a state in which a manual paper feed cover is in an open position.

As seen in FIG. 2, a manual paper feed cover 12 that is pivotally movable around its lower portion is provided at a front side of the main body 10. A sheet P placed on the manual paper feed cover 12 that is in an open position is conveyed to the image forming unit 30 by a feed roller (not shown), a registration roller 22A, and the like.

Figure 3:
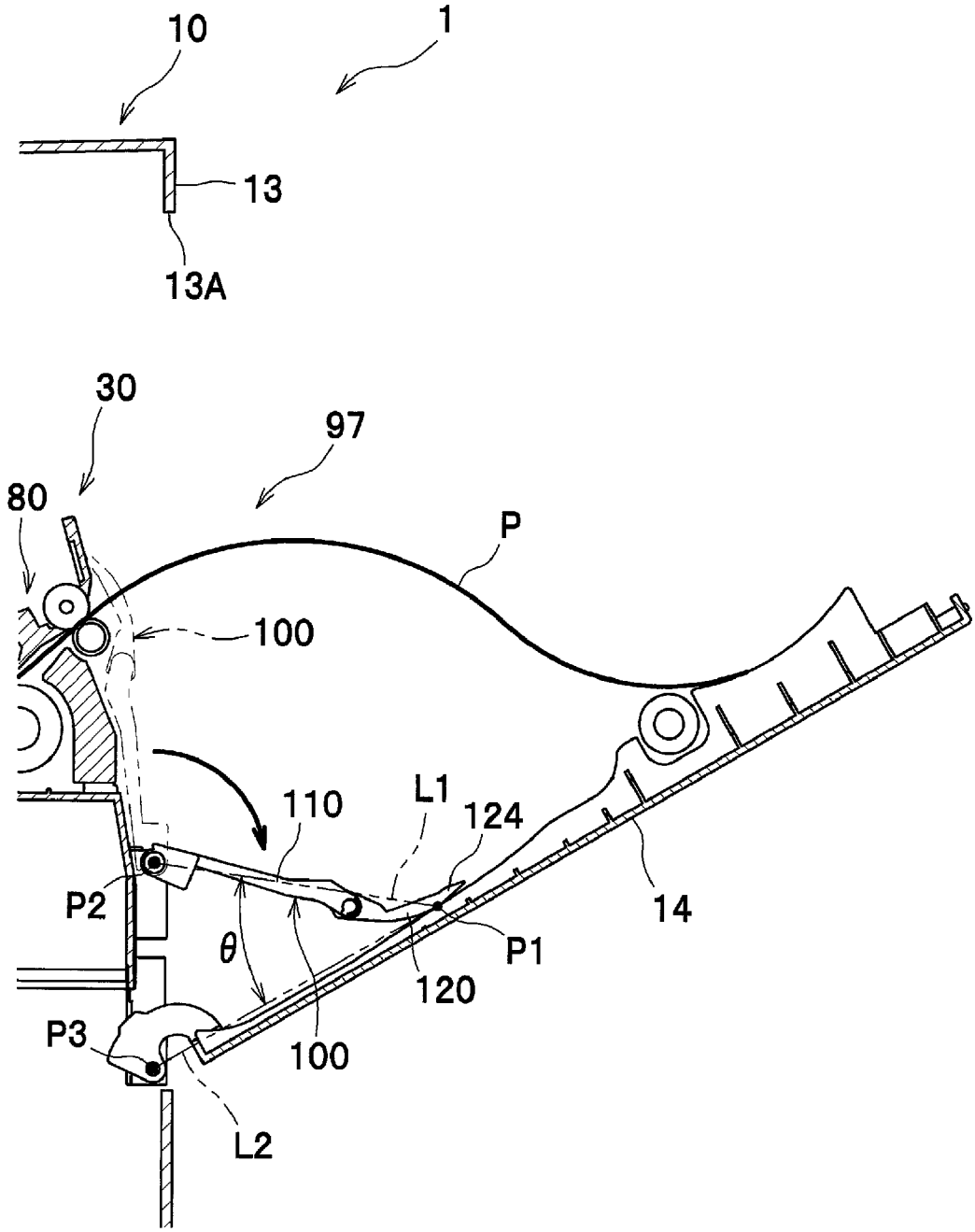
FIG. 3 is an enlarged sectional view showing a state in which a rear cover is in an open position.

As seen in FIG. 3, an opening 13A is formed in a rear wall (side wall) 13 of the main body 10. The opening 13A is opened and closed by a rear cover 14 as an example of a cover that is pivotally supported at its lower portion on the main body 10. Provided between the rear cover 14 and the fixing device 80 is a guide member 100 for guiding the sheet P.

Configuration of Guide Member

Detailed description will be given of the guide member 100 as a characteristic configuration according to the present invention.

Figure 4A:
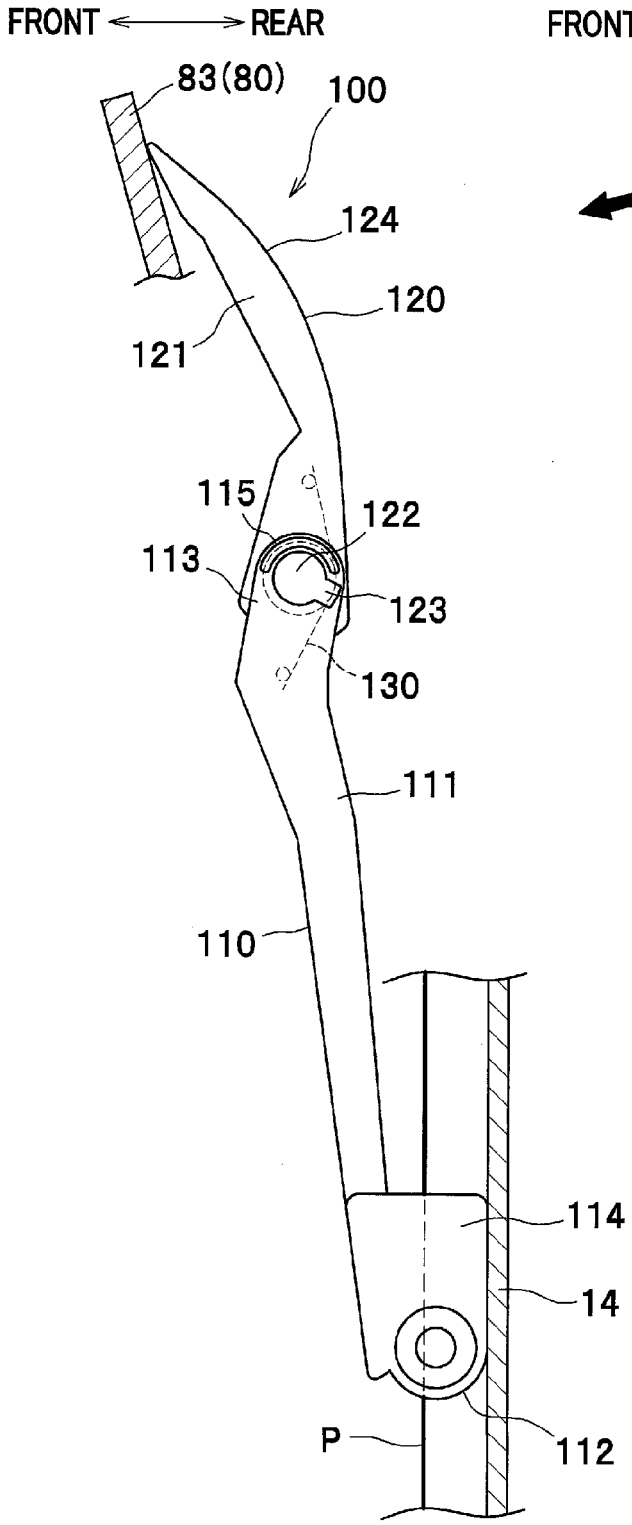
FIG. 4A is a side view showing a position of a guide member when the rear cover is in a closed position.

As seen in FIG. 4A, the guide member 100 includes a support member 110 and a flapper 120.

The support member 110 comprises a plurality of thin long plate-like rib members 111 extending in an upper and lower direction and arranged in the width direction with gaps left therebetween, and a plurality of connecting portions (not shown) for connecting these rib members 111. In order to place a sheet P on the support member 110, the plurality of rib members 111 are arranged such that the widths of the gaps are smaller than that of the sheet P. Further, the support member 110 is pivotally supported at its lower end portion 112 on the main body 10, and an upper end portion 113 of the support member 110 supports a pivot shaft 122 of the flapper 120 so to allow a pivotal movement of the flapper 120.

A restriction member 114 is provided at the lower end portion 112 of the support member 110. The restriction member 114 protrudes rearward so as to contact with the rear cover 14 in its closed position. Therefore, when the rear cover 14 is in the closed position, the restriction member 114 abuts on the rear cover 14, so that a rearward movement of the support member 110 (toward the rear cover 14) can be restricted.

In this embodiment, a pair of restriction members 114 is provided in a spaced-apart manner in the width direction of the support member 110. To be more specific, the distance between the restriction members 114 is greater than the width of the sheet P, so that the sheet P can pass through a space between the pair of restriction members 114.

A stopper rib 115 which forms a stopper mechanism for restricting a pivotal movement of the flapper 120 to be described later is provided at the upper end portion 113 of the support member 110. The stopper rib 115 is an arcuate rib concentrically formed around the pivot shaft 122 of the flapper 120, and protruding in right-left directions from an upper point above the pivot shaft 122.

A stopper rib 115 which forms a stopper mechanism for restricting a pivotal movement of the flapper 120 to be described later is provided at the upper end portion 113 of the support member 110. The stopper rib 115 is an arcuate rib concentrically formed around the pivot shaft 122 of the flapper 120, and protrusively extends in right-left directions from an upper point above the pivot shaft 122.

The flapper 120 comprises a plurality of thin long plate-like rib members 121 arcuately extending diagonally upward and forward and arranged in a right-left direction with gaps left therebetween, and the lower end portions of the rib members 121 are connected by a pivot shaft 122. As with the rib members 111 of the support member 110, the plurality of rib members 121 are arranged such that the widths of the gaps are smaller than that of the sheet P, so that a sheet P can be placed on the flapper 120.

Figure 4B:
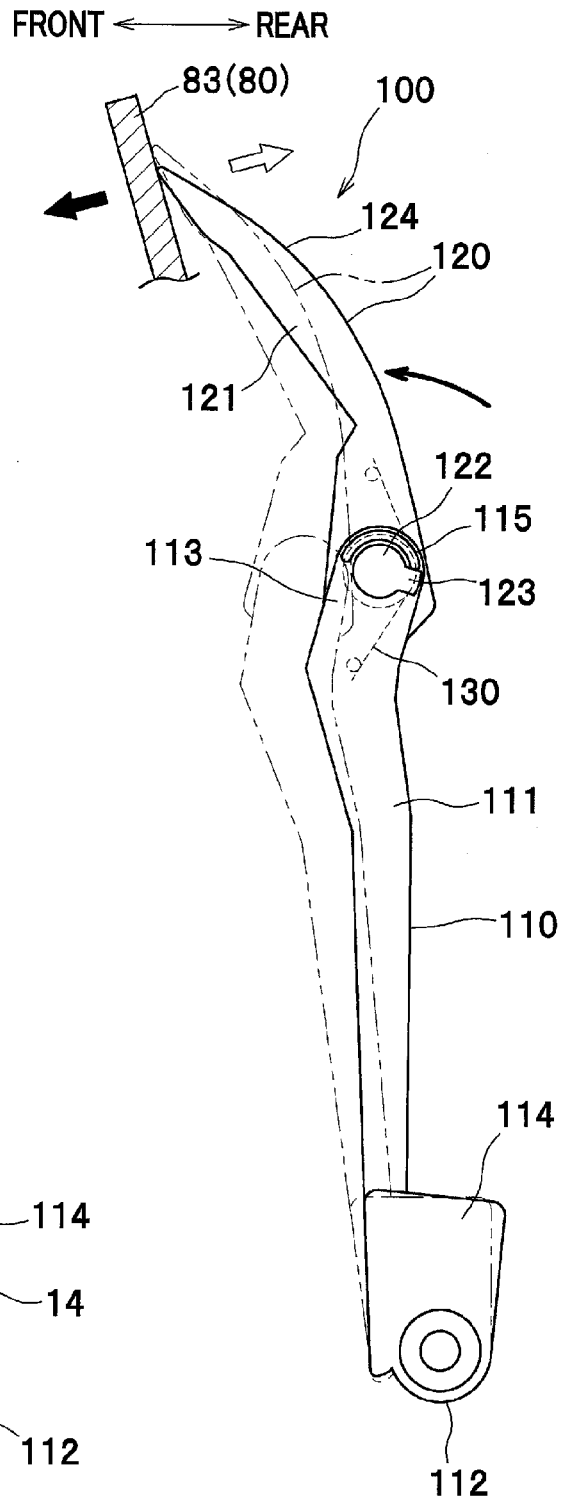
FIG. 4B is a side view showing a position of the guide member when the rear cover is being opened.

A stopper strip 123 which forms the stopper mechanism is provided at an end portion of the pivot shaft 122. The stopper strip 123 protrudes outward in a radial direction of the pivot shaft 122. As best seen in FIG. 4B, when the flapper 120 is pivoted anticlockwise (direction away from the rear cover 14), the stopper strip 123 is brought into engagement with the stopper rib 115, so that a further pivotal movement of the flapper 120 is restricted. The upper end portion 124 of the flapper 120 (i.e., the upper end portion of the guide member 100) is brought into contact with the rear cover 14 when the guide member 100 is in a lying-back position to be described later.

A torsion spring 130 as an example of an urging member for urging the flapper 120 in a forward direction is provided between the support member 110 and the flapper 120. As seen in FIG. 4A, the torsion spring 130 is configured such that when the rear cover 14 in the closed position retains the support member 110 in an upstanding position, the torsion spring 130 urges the flapper 120 toward a frame 83 (wall) of the fixing device 80.

Therefore, when the rear cover 14 is being opened, as shown in FIG. 4B, the restriction of the restriction member 114 by the rear cover 14 is released, and the guide member 100 is resiliently pushed backward due to a counteraction to a pushing force of the flapper 120 that is generated when the urging force of the torsion spring 130 causes the flapper 120 to press the frame 83. Therefore, when the rear cover 14 is being opened, the guide member 100 is automatically tilted back.

In this position as shown in FIG. 4B (i.e., in a state where the flapper 120 contacts with the frame 83 of the fixing device 80 and the stopper strip 123 and the stopper rib 115 are brought into engagement with each other), it is preferable that the center of gravity of the whole guide member 100 is positioned rearward toward the rear cover 14 beyond the pivoting center of the whole guide member 100 (i.e., the pivoting center of the support member 110 provided at the lower end portion 112). By this configuration, the weight of the guide member 100 acts as a force to pivot the guide member 100 in addition to the counteraction to the urging force of the torsion spring 130. Therefore, it is possible to reliably tilt back the guide member 100 into a lying-back position.

As best seen in FIG. 1, according to the guide member 100 configured as described above, when the rear cover 14 is in the closed position, the guide member 100 is retained in the upstanding position where the guide member 100 extends in the upper and lower direction, and the guide member 100 is positioned (in the proximity of a diverging point) between the first sheet-output passage 93 (shown by solid line) and the return passage 94 (shown by broken line) in such a manner as to face to the opening 13A. In this position of the guide member 100, because the support member 110 is restricted by the rear cover 14 and is held stationary, a large pivotal movement of the flapper 120 is possible with respect to the stationary support member 110. Namely, the flapper 120 is pivotable at large angles when the rear cover 14 is in the closed position, so that the first sheet-output passage 93 and the return passage 94 can be reliably and appropriately switched as shown in FIGS. 5A to 5C.

Figure 5A:
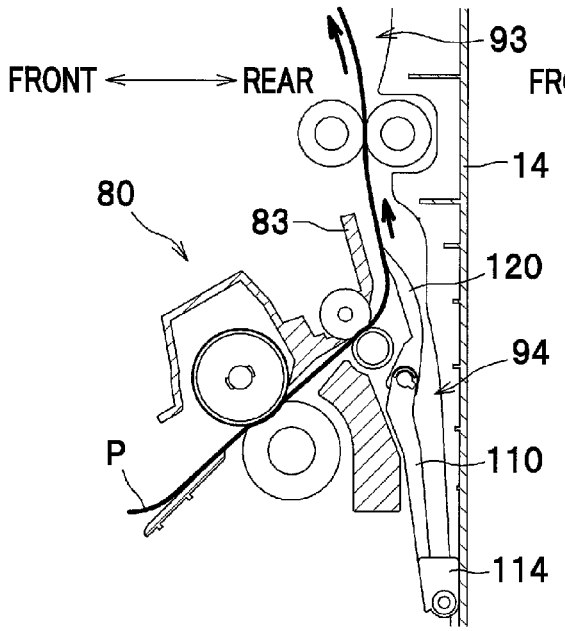
FIGS. 5A to 5C are sectional views explaining a passage switching action using a flapper.

To be more specific, as seen in FIG. 5A, when the sheet P ejected from the fixing device 80 pushes the flapper 120 backward while the rear cover 14 is in the closed position, the flapper 120 retreats from the first sheet-output passage 93 so as to allow the sheet P to pass through the first sheet-output passage 93. In other words, switching from the return passage 94 to the first sheet-output passage 93 can be performed using the flapper 120.

Figure 5B:
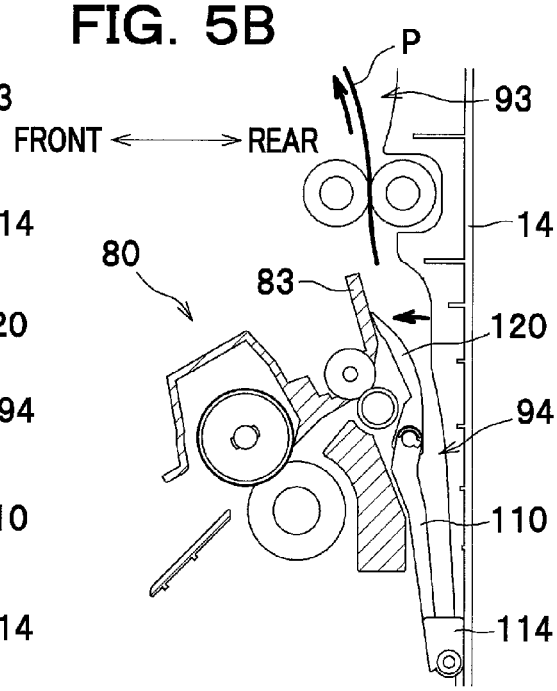

When the rear edge of the sheet P passes the flapper 120, the flapper 120 is returned to its original position as seen in FIG. 5B by the urging force of the torsion spring 130 (see FIGS. 4A and 4B). In other words, switching from the first sheet-output passage 93 to the return passage 94 can be performed using the flapper 120.

Figure 5C:
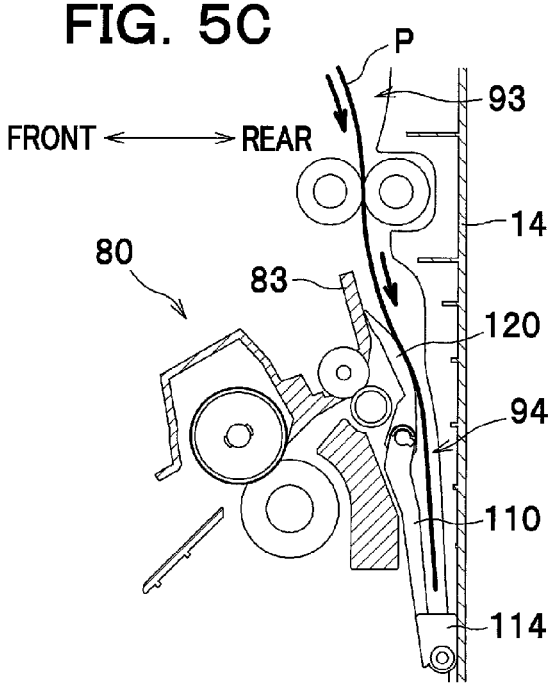

Thereafter, as seen in FIG. 5C, when the sheet P is conveyed in the reverse direction by the switch back action, the sheet P is guided by a rear surface of the flapper 120 and supplied to the return passage 94.

Movement of Guide Member when Opening/Closing Rear Cover

Movement of the guide member 100 when opening or closing the rear cover 14 will be described. As seen in FIG. 3, when the rear cover 14 is being opened, the guide member 100 is pushed backward due to the counteraction to the urging force of the torsion spring 130 as described above, and the guide member 100 is pivoted around its lower end portion as a pivot axis so that the upper end portion 124 is tilted back toward the opened rear cover 14 and into the lying-back position. During this time, the pivotal movement of the flapper 120 is restricted by the engagement between the stopper strip 123 and the stopper rib 115 (i.e., the stopper mechanism) (see FIG. 4B). This can prevent the flapper 120 from being folded into a facing position where the flapper 120 faces to the support member 110.

To be more specific, the guide member 100 is tilted back while the flapper 120 and the support member 110 are kept in a substantially straight orientation (i.e., an angle made by the flapper 120 and the support member 110 is obtuse as shown in FIG. 4B). Thereafter, when the upper end portion 124 of the guide member 100 is brought into contact with the opened rear cover 14, the guide member 100 is supported by the rear cover 14. This position of the guide member 100 is referred to as the lying-back position.

Accordingly, a second sheet-output passage 97 extending from the fixing device 80 (image forming unit 30) toward the opened rear cover 14 through the opening 13A is formed. Once the second sheet-output passage 97 is formed, a so-called straight-through output becomes available, in which a sheet P placed on the opened manual paper feed cover 12 such as shown in FIG. 2 is conveyed, while being printed, in a front-back direction along a substantially straight sheet conveyance passage and the printed sheet P is ejected onto the rear cover 14. During the straight-through output, the guide member 100 is functioned as an auxiliary tray for placing the rear edge of the sheet P.

Further, because the upper end portion 124 of the guide member 100 in the lying-back position contacts with the opened rear cover 14, it is possible to prevent the sheet P ejected onto the rear cover 14 from going into the return passage 94 within the main body 10 through a gap formed between the upper end portion 124 of the guide member 100 and the rear cover 14.

Figure 6A:
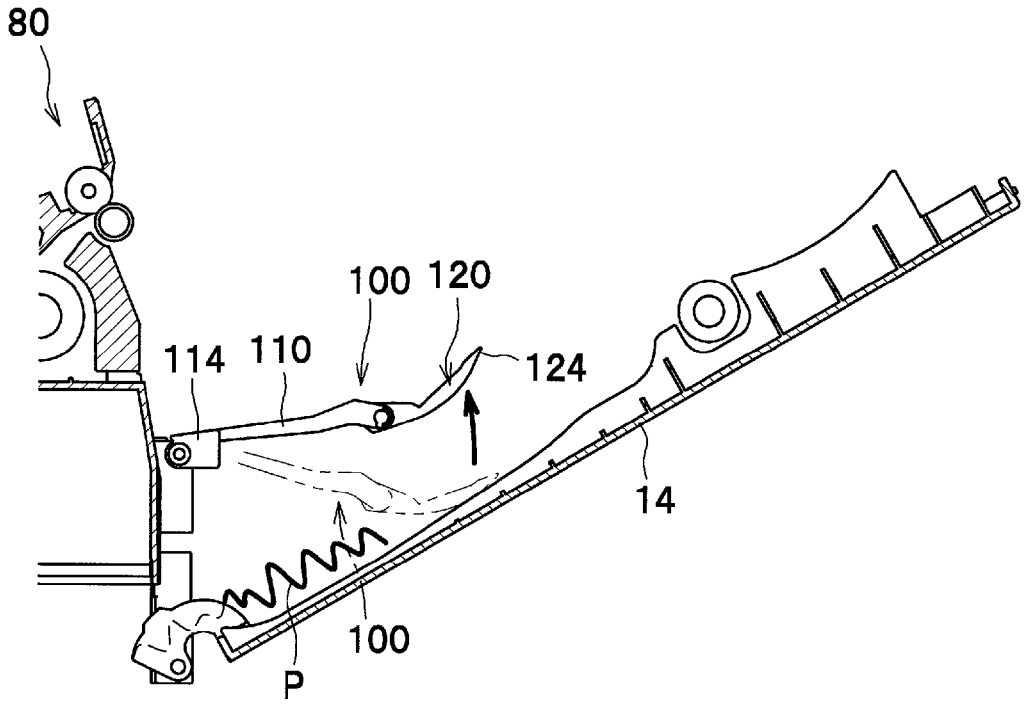
FIG. 6A is a sectional view explaining how to fix a paper jam between the rear cover and the guide member.

Further, the guide member 100 in the lying-back position is supported by the opened rear cover 14 and no connecting member is used between the guide member 100 and the rear cover 14. Therefore, the guide member 100 is movable to a position away from the opened rear cover 14. By this configuration, as seen in FIG. 6A, even if a sheet P gets jammed between the rear cover 14 and the guide member 100 when the rear cover 14 is in the open position, the jammed sheet P can be easily removed simply by raising the guide member 100 upward.

Further, as seen in FIG. 3, when the guide member 100 in the lying-back position, a line L1 connecting a contacting point P1 positioned between the upper end portion 124 of the guide member 100 and the rear cover 14 with a pivoting center P2 of the guide member 100, and a line to L2 connecting the contacting point P1 with a pivoting center P3 of the rear cover 14, form an angle θ that is an acute angle. Hereinafter, the angle θ made by the line L1 and the line L2 indicates an angle near the main body 10, selected from two angles formed by the lines L1 and L2. In other words, the angle θ is an internal angle of a triangle defined by connecting the contacting point P1 and the two pivoting centers P2, P3 and corresponds to the contacting point P1 as an apex of the triangle.

Although FIG. 3 shows the contacting point P1 in a planer manner, the upper end portion 124 of the guide member 100 contacts with the opened rear cover 14 at a plurality of contact points P1. These contact points P1 are arranged along a direction in which a pivot shaft (pivoting center P2) of the guide member 100 extends.

Figure 6B:
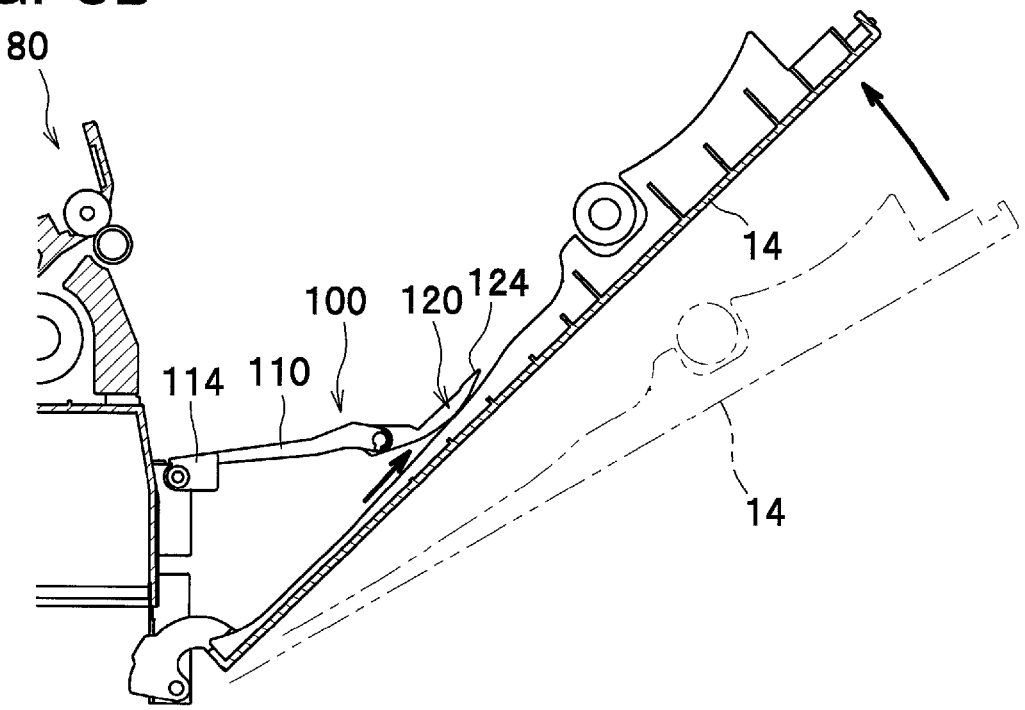
FIG. 6B is a sectional view showing a movement of the guide member when the rear cover is being closed.

Because the angle θ is an acute angle, when a distal end of the rear cover 14 is lifted up to close the rear cover 14 as shown in FIG. 6B, the upper end portion 124 of the guide member 100 (the upper end portion 124 of the flapper 120) is pivoted upward while being supported by the rear cover 14. Thereafter, that portion of the guide member 100 which is supported by the rear cover 14 until the rear cover 14 is fully closed is changed from the flapper 120 to the restriction member 114 of the support member 110, and the restriction member 114 is pushed forward by the rear cover 14.

The upper end portion 124 of the guide member 100 contacts with the rear cover 14 at a curved contact surface that extends away from the opened rear cover 14. By this configuration of the upper end portion 124, when the rear cover 14 is being closed, the curved surface of the upper end portion 124 of the support member 100 can smoothly and slidably contact with the rear cover 14 without being trapped on the rear cover 14.

Thereafter, as best seen in FIG. 4B, when the upper end of the flapper 120 is brought into contact with the frame 83 of the fixing device 80, the support member 110 is pushed forward by the rear cover 14 and pivoted with respect to the flapper 120, the movement of which has been stopped by the frame 83. Therefore, as seen in FIG. 4A, both ends of the torsion spring 130 are pushed open as an angle between the flapper 120 and the support member 110 becomes wider, so that the upper end of the flapper 120 is urged against the frame 83 of the fixing device 80. This means that only closing the rear cover 14 causes the guide member 100 to be positioned in the normal position at which the first sheet-output passage 93 and the second sheet-output passage 94 can be switched over.

According to the color printer 1 in this embodiment, the following advantageous effects can be expected.

Because the guide member 100 is configured to be movable to a position away from the opened rear cover 14, even if a sheet P gets jammed between the rear cover 14 and the guide member 100, the jammed sheet P can be easily removed.

Further, there is provided the restriction member 114 for restricting the pivotal movement of the support member 100 toward the rear cover 14 when the rear cover 14 is in the closed position. This allows a large pivotal movement of the flapper 120 around a connecting shaft (pivot shaft 122) between the support member 110 and the flapper 120, leading to a smooth and reliable passage switching operation. Further, when the rear cover 14 is being opened, the guide member 100 is pivoted around the connecting shaft (pivot axis) connecting between the main body 10 and the support member 110. This makes is possible to move the rear cover 14 and the upper end of the guide member 100 closer to each other (in this embodiment, the rear cover 14 and the upper end of the guide member 100 are brought into contact with each other), so as to prevent the sheet P from going into the main body 10 through a gap formed therebetween.

Further, there is provided the torsion spring 130 for urging the flapper 120 toward the frame 83 of the fixing device 80. Therefore, when the rear cover 14 is being opened, the flapper 120 is tilted back in a direction away from the frame 83 due to the counteraction to the urging force of the torsion spring 130.

This makes it possible to automatically tilt back the guide member 100 into the lying-back position and to quickly prepare for the straight-through output.

Because the upper end portion 124 of the guide member 100 is configured to contact with the opened rear cover 14, it is possible to reliably prevent the sheet P from falling down from a gap between the upper end portion 124 of the guide member 100 and the rear cover 14.

Further, an engagement between the stopper strip 123 and the stopper rib 115 restricts a pivotal movement of the flapper 120, so as to prevent the flapper 120 from being folded into the facing position where the flapper 120 faces to the support member 110 when the guide member 100 is tilted back. Namely, if the stopper mechanism such as including the stopper strip 123 and the stopper rib 115 is not provided, the flapper 120 will be folded to approach toward the support member 110. This disadvantageously results in a difficulty in contacting the flapper 120 with respect to the rear cover 14. According to the color printer 1 in this embodiment, the upper end portion 124 of the guide member 100 can be reliably brought into contact with the rear cover 14 without a gap formed therebetween.

Further, the upper end portion 124 of the guide member 100 is brought into contact with the rear cover 14 when the guide member 100 is in the lying-back position. This can prevent the sheet P ejected onto the rear cover 14 from going into the main body 10 through a gap formed between the upper end portion 124 and the rear cover 14.

Because the angle made by the line L1 that connects the contacting point P1 and the pivoting center P2 of the guide member 100 and the line L2 that connects the contacting point P1 and the pivoting center P3 of the rear cover 14 is an acute angle, the rear cover 14 and the guide member 100 can be closed together with the guide member 100 being supported by the rear cover 14.

The upper end portion 124 of the guide member 100 contacts with the rear cover 14 at a curved contact surface that extends away from the opened rear cover 14. By this configuration of the upper end portion 124, when the rear cover 14 is being closed, the curved surface of the upper end portion 124 of the guide member 100 can smoothly slide on the rear cover 14, so that the guide member 100 can be readily closed together with the rear cover 14.

Although the present invention has been described in detail with reference to the above embodiment, the present invention is not limited to this specific embodiment and various changes and modifications as described below may be made without departing from the scope of the appended claims.

Figure 7:
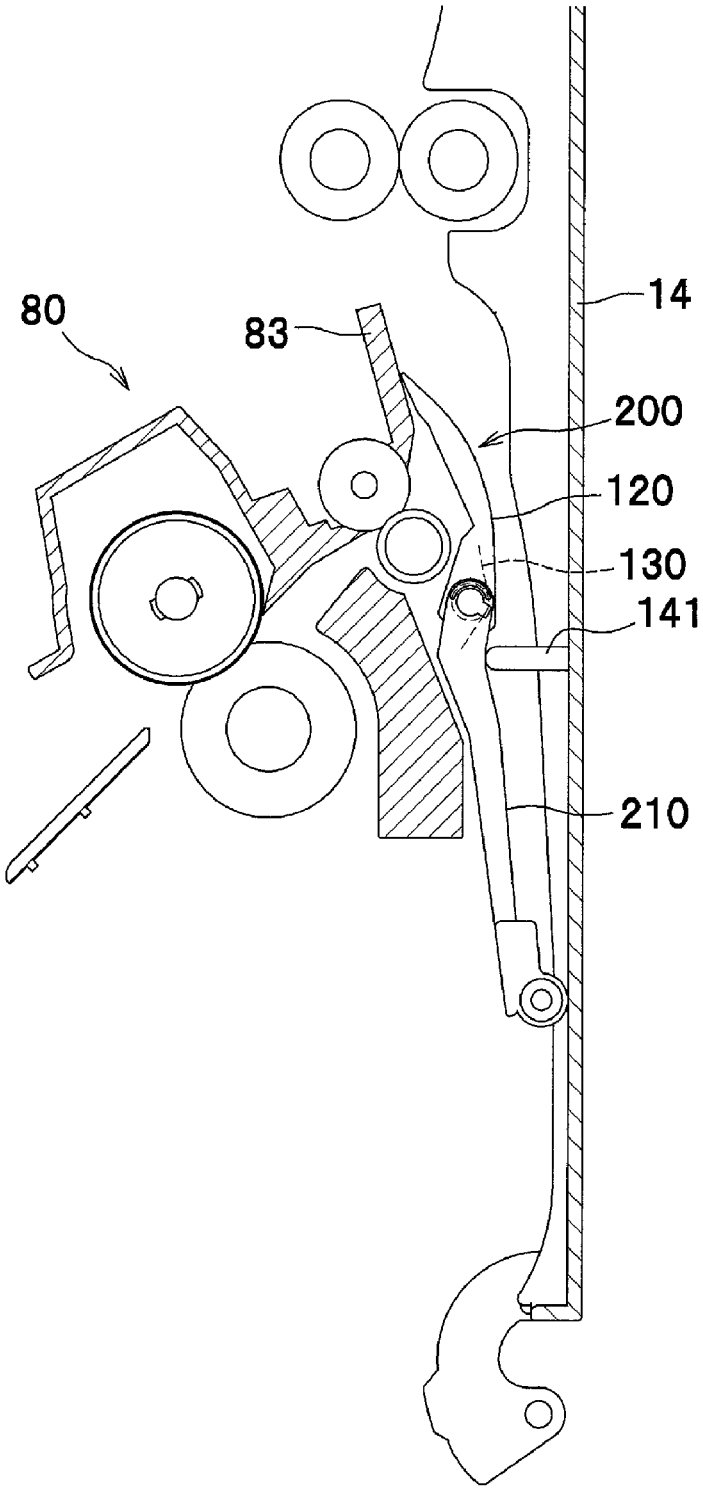
FIG. 7 is a sectional view showing a modification of a restriction member.

The restriction member 114 is provided on the support member 110 in the above embodiment. However, the present invention is not limited to this specific embodiment. For example, as shown in FIG. 7, a restriction member 141 may be provided on the rear cover 14. More specifically, the restriction member 141 protrudes from the rear cover 14 toward a guide member 200.

Figure 8:
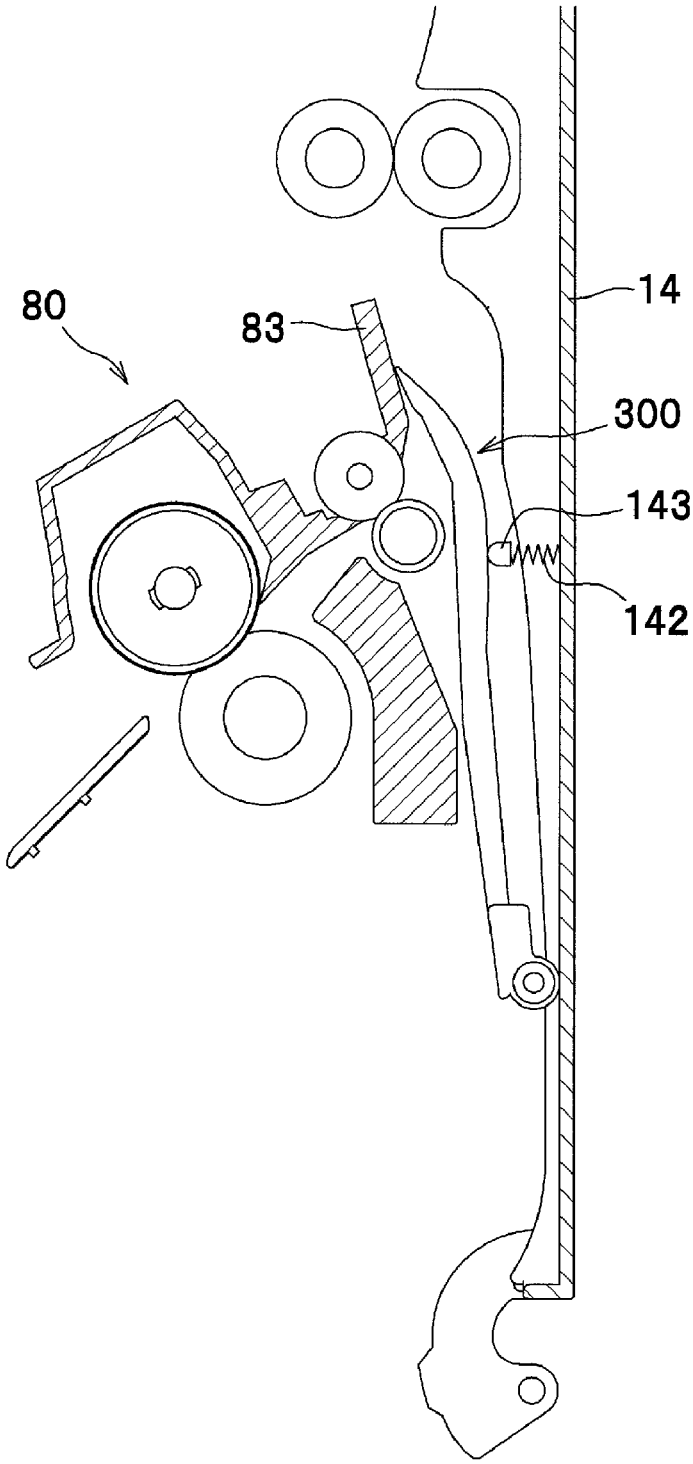
FIG. 8 is a sectional view showing a modification in which the guide member is constructed from a single part.

In this modification, the guide member 200 as shown in FIG. 7 includes the flapper 120 and the torsion spring 130, etc. that are identical to those described in the above embodiment, and a support member 210 with a restriction member that is configured to be smaller than the restriction member 114 of the support member 110 in the above embodiment so as not to contact with the rear cover 14. In FIG. 7 and FIG. 8 to be described later, like reference characters designate identical parts as described in the above embodiment, and detailed description thereof will be omitted.

The restriction member 141 provided on the rear cover 14 is arranged on the support member 210 at a position close to the pivoting center of the flapper 120. Therefore, when the rear cover 14 is in the closed position, the restriction member 141 supports the proximity area of the pivoting center of the flapper 120. This can advantageously suppress backlash of the support member 210 as compared with a configuration in which a restriction member supports an area far from the pivoting center, and a smooth and reliable passage switching operation using the flapper 120 can be realized.

In the above embodiment, the guide member 100 consists of the support member 110 and the flapper 120. However, the present invention is not limited to this specific embodiment. For example, as shown in FIG. 8, a guide member 300 may be made from a single part. More specifically, the guide member 300 is shaped to integrate the support member 210 shown in FIG. 7 and the flapper 120, that is, similar to the guide member 100 in the above embodiment without providing the restriction member 114.

In this modification, the rear cover 14 is provided with a coil spring 142 and a contact member 143 provided at a free end of the coil spring 142 and contacting with the guide member 300. According to this configuration too, a smooth and reliable passage switching operation using the guide member 300 can be realized because of the urging force of the coil spring 142. Further, the guide member 300 is movable to a position away from the opened rear cover 14 when the rear cover 14 is fully opened. Therefore, even if a sheet P gets jammed between the rear cover 14 and the guide member 300, the jammed sheet P can be easily removed.

According to this modification, the guide member 300 is not automatically tilted back into a lying-back position when the rear cover 14 is being opened. However, when the guide member 300 is pushed by hand or by a sheet P ejected from the fixing device 80, the guide member 300 is tilted back into the lying-back position. Furthermore, the guide member 300 may be positioned in a lean-back position from the position illustrated in FIG. 8. In other words, the center of gravity of the guide member 300 may be positioned rearward toward the rear cover 14 beyond the pivoting center of the guide member 300. This makes it possible to cause the guide member 300 to be tilted back by its own weight when the rear cover 14 is being opened.

In the above embodiment, the support member 110 and the flapper 120 are formed by connecting a plurality of rib members arranged in a right-left direction. However, the present invention is not limited to this specific embodiment. For example, a support member and/or a flapper may be a single plate member extending in both right-left and upper-lower directions. However, it is preferable that the support member and the like are formed by connecting a plurality of rib members extending in the sheet conveyance direction as described in the above embodiment. This is because a contacting area between the sheet P and the support member and the like becomes smaller, so that a sheet conveyance resistance becomes smaller and the sheet P can be conveyed smoothly.

In the above embodiment, the flapper 120 is urged against the frame 83 of the fixing device 80. However, the present invention is not limited to this specific embodiment. As long as the flapper 120 is urged against a wall portion that is arranged opposite to the rear cover with the flapper interposed therebetween, the wall portion may be a wall integral with the main body.

In the above embodiment, switching the passages is carried out by pivoting the flapper 120. However, the present invention is not limited to this specific embodiment. For example, as disclosed in the conventional art (Japanese Laid-open Patent Publication No. 2006-330172), a guide member which is not pivotable during the time the rear cover is in the closed position may be arranged between the first sheet-output passage and the return passage. In this arrangement of the guide member, switching the passages is carried out using the resiliency of the sheet P. To be more specific, the sheet P is conveyed along one curved passage while being guided by the guide member, and then goes out the passage past the guide member. Due to the resiliency of the sheet P, the tail-end of the sheet P returns to its original shape from its curved shape, so that when the sheet P is conveyed in the reverse direction, the tail-end (now it becomes the leading-end) of the sheet P goes into the other passage positioned outside the one passage. In this modification too, the guide member is not connected to the rear cover, and further the guide member is configured to be movable with respect to the opened rear cover. Therefore, even if a sheet P gets jammed between the guide member and the rear cover, the jammed sheet P can be easily removed.

In the above embodiment, the upper end portion 124 of the guide member 100 is brought into contact with the opened rear cover 14. However, in order to keep the upper end portion 124 of the guide member 100 slightly away from the rear cover 14 when the guide member 100 is in the lying-back position, a portion protruding from the rear cover 14 may support an area other than the upper end portion 124 of the guide member, or alternatively, the guide member 100 may be supported by the main body.

In the above embodiment, the torsion spring 130 is used as the urging member. However, a wire spring or a plate spring may be employed as the urging member.

In the above embodiment, the present invention is adapted to the color printer 1. However, the present invention may be adapted to other image forming apparatuses, such a copying machine and a multifunction device.

In the above embodiment, as an example of the recording sheet, the sheet P includes, for example, a cardboard, a postcard, and a thin paper. However, an OHP sheet may be used as the recording sheet.

In the above embodiment, the rear cover 14 is used as the cover. However, in the case where the straight-through output is carried out in the right-left direction, the cover may be a side cover and the guide member is provided between the side cover and the image forming unit.

In the above embodiment, an exposure is performed using LEDs in the image forming unit. However, various types of exposure devices, such as using a laser light, may be available.

Figure 9:
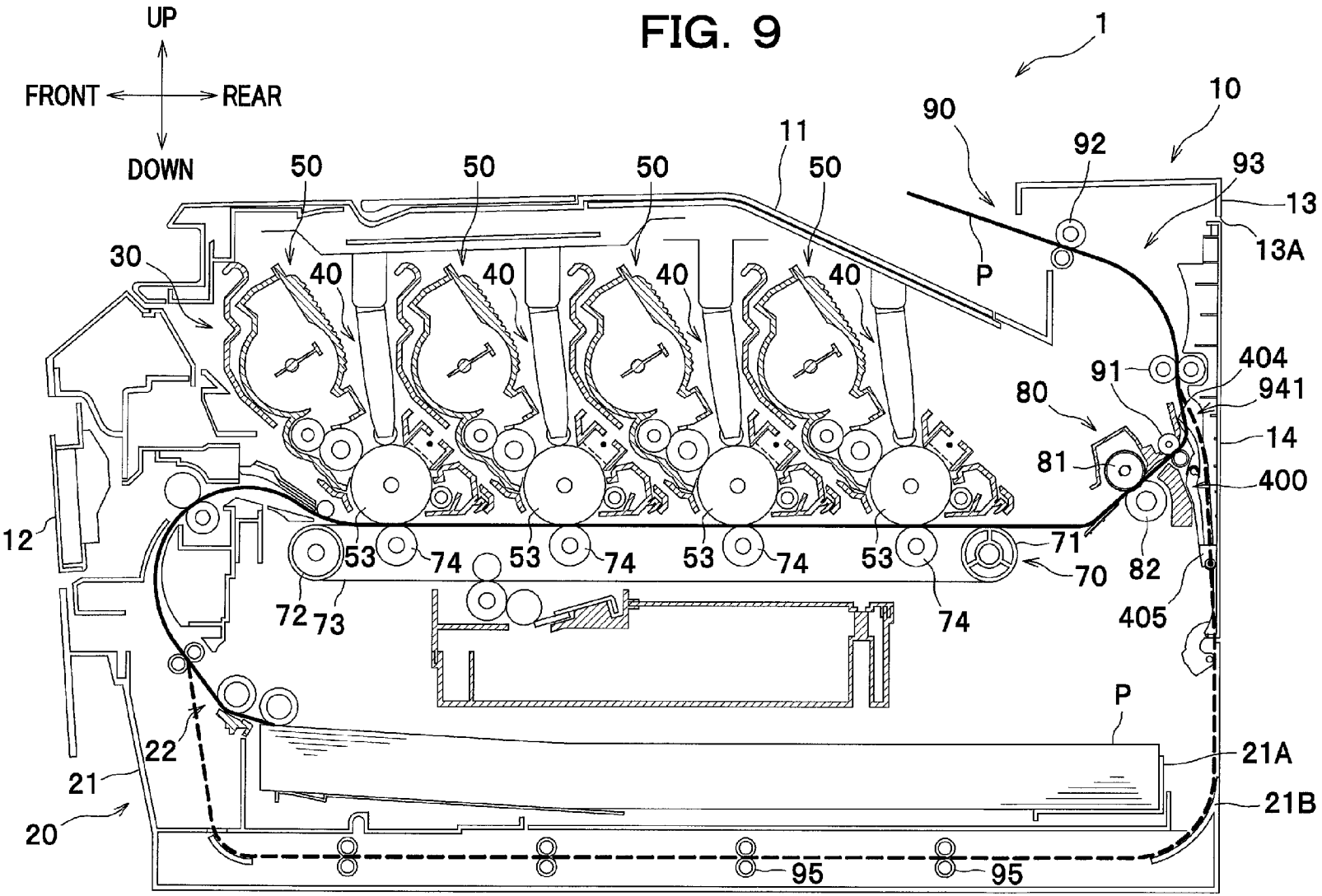
FIG. 9 is a sectional view showing a modification of a color printer in which a return passage is formed below a sheet feed tray.
Figure 10:
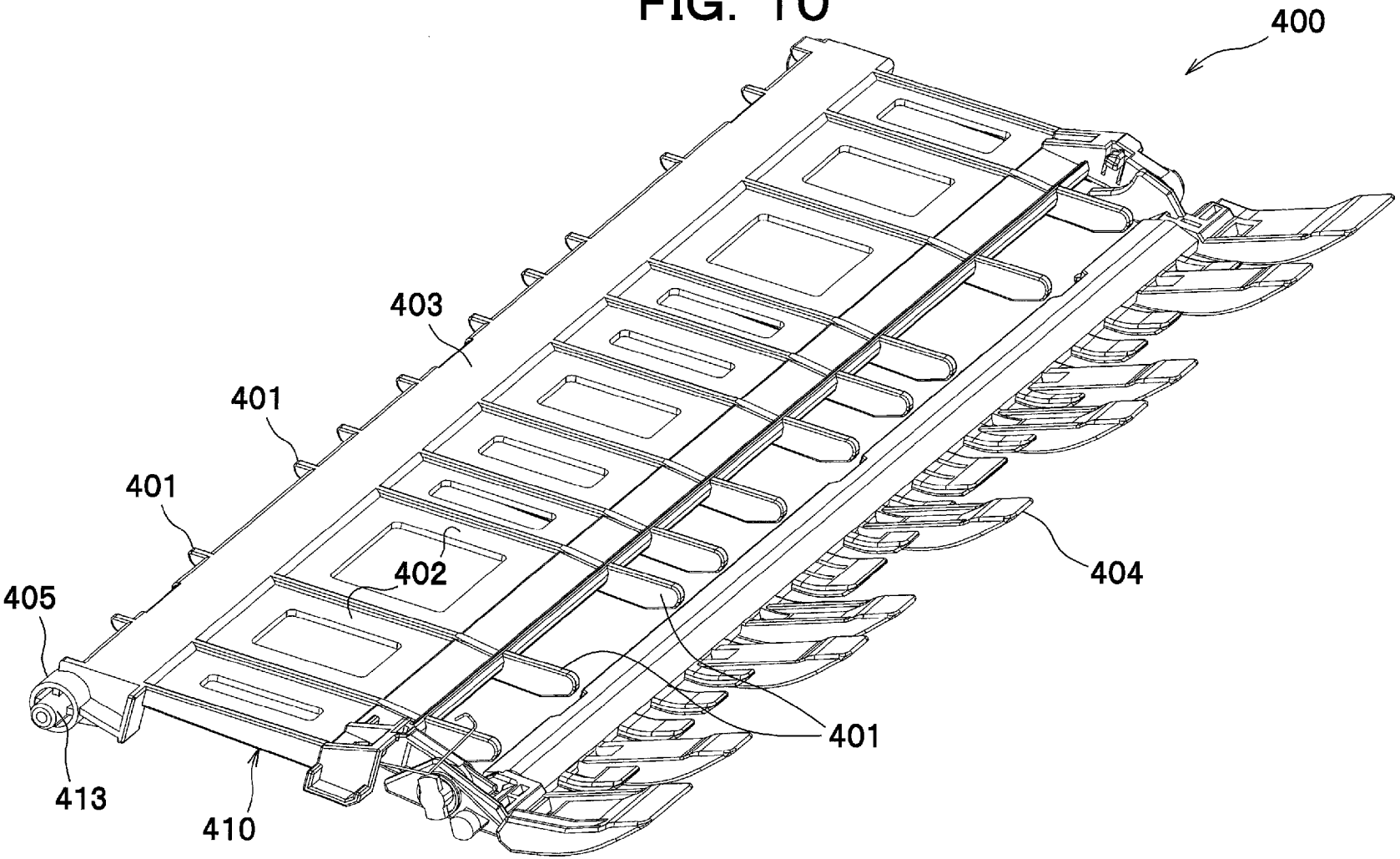
FIG. 10 is a perspective view showing a modification of the guide member.

In the above embodiment, the return passage 94 extends above the sheet feed tray 21. However, the present invention is not limited to this specific embodiment. As seen in FIG. 9, a return passage 941 may be disposed to extend below the sheet feed tray 21. In this modification, as best seen in FIG. 10, it is preferable that a guide member 400 is provided with a plurality of wall portions (e.g., wall portions 401, 402) arranged in the width direction of the sheet with gaps which are smaller than the width of the sheet left therebetween and/or a single continuous wall portion (e.g., wall portion 403) arranged in the width direction of the sheet; the wall portions and the single continuous wall are preferably provided in the whole area extending from an upper end portion 404 to a lower end portion 405.

By this configuration in which the wall portions 401-403 are provided in the whole area extending from the upper end portion 404 to the lower end portion 405, the guide member 400 does not have any gaps for allowing the sheet P to pass therethrough (i.e., gap having a width greater than the width of the sheet P). This can advantageously prevent the sheet P from going into the main body 10 through a gap formed in the guide member 400 when the guide member 400 is in the lying-back position.

Further, as seen in FIG. 9, the return passage 941 runs between the rear cover 14 and the whole area of the guide member 400 extending from the upper end portion 404 to the lower end portion 405. Therefore, the sheet P can be reliably conveyed in a direction where the lower end portion 405 of the guide member 400 is directed to. In other words, the guide member 400 can reliably guide the sheet P between a sheet storage portion 21A (in which a stack of sheets P are stored) of the sheet feed tray 21 and a rear wall 21B of the sheet feed tray 21.

Figure 11:
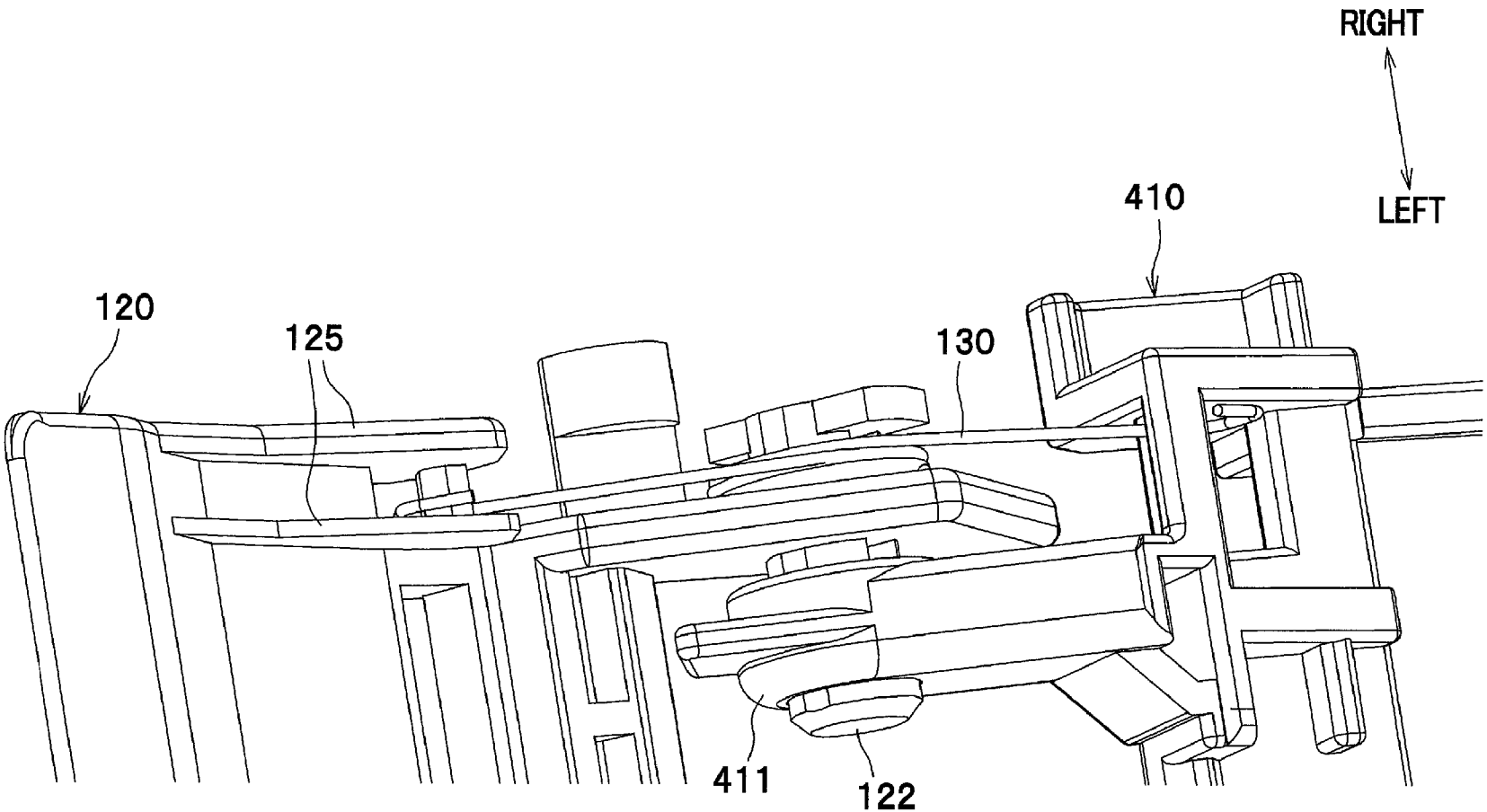
FIG. 11 is an enlarged perspective view showing a right-side of a connecting member for connecting a support member and a flapper as shown in FIG. 10.
Figure 12:
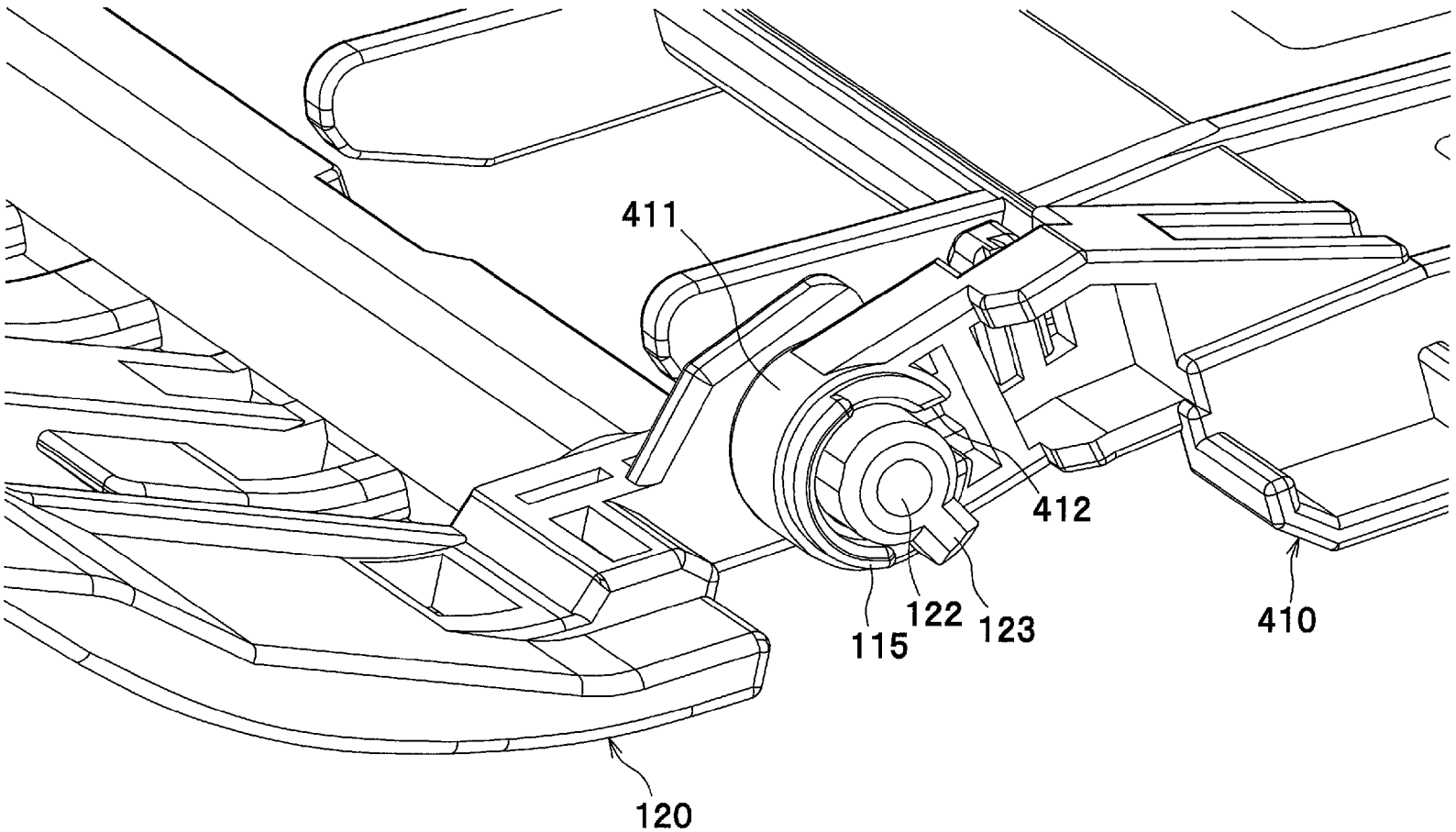
FIG. 12 is an enlarged perspective view showing a left-side of the connecting member of FIG. 10.
Figure 13A:
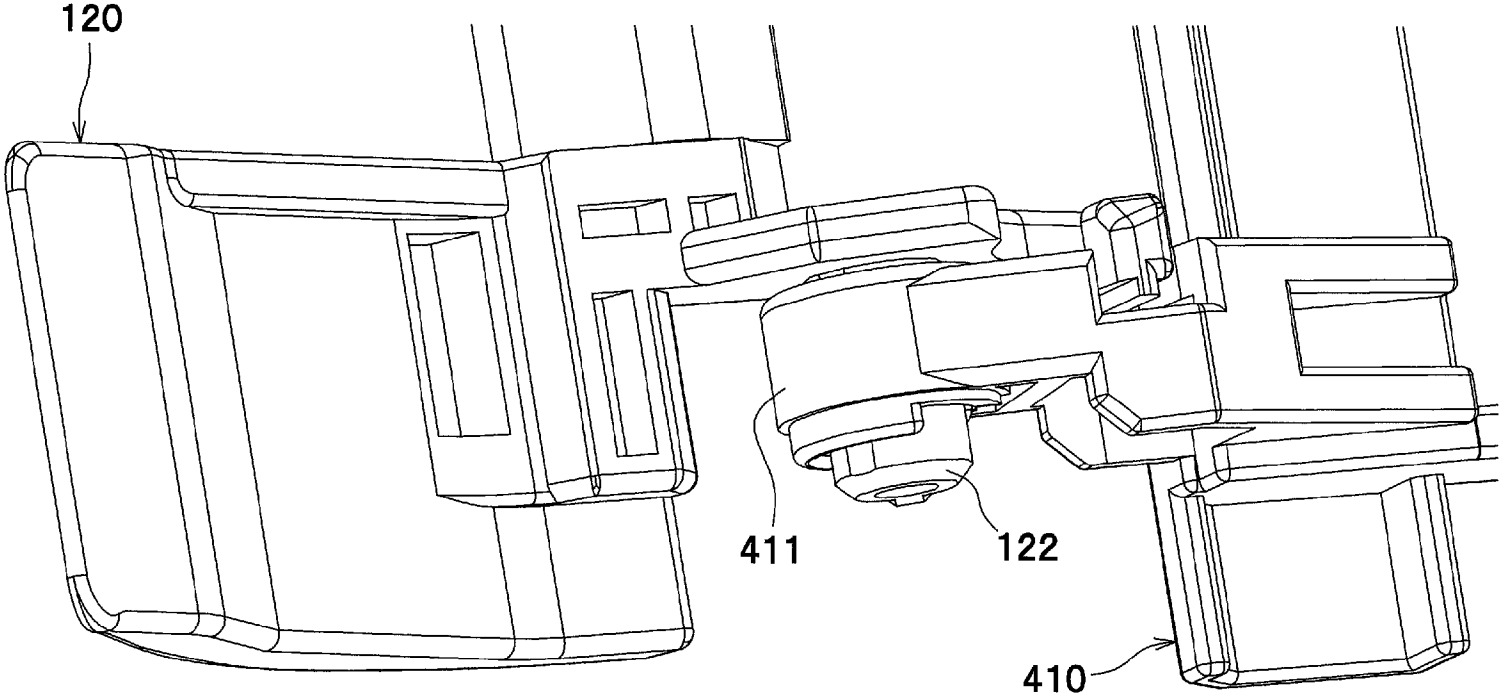
FIG. 13A is an enlarged perspective view of the left-side of the connecting member of FIG. 10 as seen from a different direction.
Figure 13B:
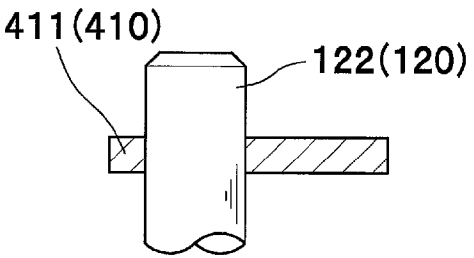
FIG. 13B is an explanatory view of the connecting member.

Further, as seen in FIGS. 11 and 12, it is preferable that the torsion spring 130 for urging the flapper 120 is arranged on one end side of the width direction, and that a stopper strip 123 and a stopper rib 115 for restricting a pivotal movement of the flapper 120 caused by the torsion spring 130 are arranged on the opposite end side. In FIGS. 11-12 and FIG. 13 to be described later, like reference characters designate identical parts as described in the above embodiment, and detailed description thereof will be omitted. In this modification, as compared with a configuration in which the torsion spring 130, the stopper strip 123 and the stopper rib 115 are arranged on the same side of the width direction, the stopper strip 123 and the stopper rib 115 can be enlarged to have sufficient strength while realizing a reduction in the whole size.

Further, as seen in FIG. 12, a support member 410 has a bearing portion 411 for supporting the pivot shaft 122 of the flapper 120, and it is preferable that a groove 412 for attaching the flapper 120 to the bearing portion 411 is formed in a position out of a normal pivoting range of the stopper strip 123 (flapper 120), in which the stopper strip 123 (flapper 120) is normally pivoted during the usage of the printer. By this configuration, disengagement of the stopper strip 123 from the groove 412 can be prevented, thereby inhibiting the flapper 120 from coming off the support member 410 during the normal pivotal movement of the flapper 120.

Further, as seen in FIG. 11, it is preferable to provide on the flapper 120 a rib (ribs) 125 protruding forward beyond a front end of the torsion spring 130. This makes it possible to keep out the user from the front end of the torsion spring 130, and an engagement between the torsion spring 130 and the flapper 120 can be retained in a reliable manner.

Figure 13C:
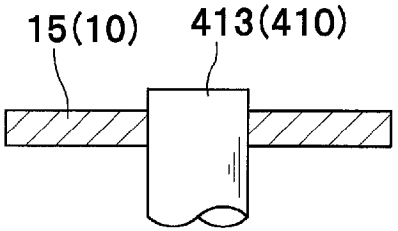
FIG. 13C is an explanatory view showing a connecting member for connecting the support member and the main body.

Further, it is preferable that the amount of protrusion of the pivot shaft 122 of the flapper 120 from the bearing portion 411 of the support member 410 (see FIG. 11 and FIGS. 13A-13B) is greater than the amount of protrusion of a pivot shaft 413 of the support member 410 from a bearing portion 15 of the main body 10 (see FIGS. 10 and 13C). By this configuration, if an intensive load is applied to the guide member 400, the support member 410 comes off the main body 10 before the flapper 120 comes off the support member 410. This is advantageous as compared with a configuration in which the flapper 120 comes off the support member 410 before the support member 410 comes off the main body 10, because reattachment of the guide member 400 to the main body 10 is readily performed without the need of reattachment of the torsion spring 130.

What is claimed is:

1. An image forming apparatus comprising:

a main body having a side wall in which an opening is formed;

a cover pivotally supported at its lower portion on the main body and configured to open and close the opening;

an image forming unit configured to form an image on a recording sheet;

a first sheet-output passage configured to guide the recording sheet, which is conveyed from the image forming unit toward the opening along a recording sheet conveyance direction, to a sheet-output tray positioned outside the main body;

a return passage connected to the first sheet-output passage and configured to guide the recording sheet from the first sheet-output passage back to a position upstream from the image forming unit as viewed in the recording sheet conveyance direction; and a guide member for guiding the recording sheet, and configured to switch between the first sheet-output passage and the return passage and arranged between the first sheet-output passage and the return passage and facing the closed cover, wherein the guide member is pivotally supported at its lower portion on the main body, wherein the guide member has a first side facing the cover and a second side opposite the first side, and the recording sheet passes the guide member on the second side when being conveyed along the first sheet-output passage and on the first side when being conveyed along the return passage;

wherein when the cover is being opened and the guide member is pivoted around the lower portion as a pivot axis so that an upper portion of the guide member is tilted toward the opened cover and into a lying-back position, a second sheet-output passage is formed which extends from the image forming unit toward the opened cover, such that a recording sheet is configured to pass over the second side of the guide member, and wherein the guide member is configured to be movable to a position away from the opened cover when it is in the lying-back position.

2. The image forming apparatus according to claim 1, wherein the guide member comprises a support member having said lower portion, a flapper pivotally connected to a portion of the support member above the lower portion so as to switch between the first sheet-output passage and the return passage by a pivotal movement of the flapper, and a restriction member provided on either one of the cover and the support member and configured to restrict movement of the support member toward the cover when the cover is in a closed position.

3. The image forming apparatus according to claim 2, wherein the main body has a wall arranged on the opposite side of the cover with the flapper interposed therebetween, and wherein an urging member is provided between the flapper and the support member so as to urge the flapper toward the wall.

4. The image forming apparatus according to claim 2, wherein the restriction member is provided on the support member at a position close to a pivoting center of the flapper.

5. The image forming apparatus according to claim 1, wherein the guide member is configured such that when it is tilted toward the opened cover, the upper portion of the guide member is brought into contact with the cover.

6. The image forming apparatus according to claim 3, wherein a stopper mechanism is provided at the flapper and the support member so as to prevent the flapper from being folded by an urging force of the urging member into a facing position where the flapper faces to the support member.

7. An image forming apparatus comprising:

a main body having a side wall in which an opening is formed;

a cover pivotally supported at its lower portion on the main body and configured to open and close the opening;

an image forming unit configured to form an image on a recording sheet;

a first sheet-output passage configured to guide the recording sheet, which is conveyed from the image forming unit toward the opening along a recording sheet conveyance direction, to a sheet-output tray positioned outside the main body;

a return passage connected to the first sheet-output passage and configured to guide the recording sheet from the first sheet-output passage back to a position upstream from the image forming unit as viewed in the recording sheet conveyance direction; and a guide member for guiding the recording sheet, and configured to switch between the first sheet-output passage and the return passage and arranged between the first sheet-output passage and the return passage and facing the closed cover, wherein the guide member is pivotally supported at its lower portion on the main body, wherein the guide member has a first side facing the cover and a second side opposite the first side, and the recording sheet passes on the second side when being conveyed along the first sheet-output passage and on the first side when being conveyed along the return passage;

wherein when the cover is being opened and the guide member is pivoted around the lower portion as a pivot axis so that an upper portion of the guide member is tilted toward the opened cover and into a lying-back position, a second sheet-output passage is formed which extends from the image forming unit toward the opened cover, such that a recording sheet is configured to pass over the second side of the guide member, and wherein the guide member is configured such that the upper portion of the guide member is in contact with the opened cover when it is in the lying-back position.

8. The image forming apparatus according to claim 7, wherein a line connecting a contacting point between the upper portion of the guide member and the cover with a pivoting center of the guide member, and a line connecting the contacting point with a pivoting center of the cover, form an acute angle.

9. The image forming apparatus according to claim 8, wherein the upper portion of the guide member contacts with the cover at a curved contact surface that extends away from the opened cover.

10. The image forming apparatus according to claim 7, wherein the return passage runs between the lower portion of the guide member and the cover, and wherein the guide member comprises a plurality of walls arranged in a width direction of a recording sheet with a gap smaller than a width of the recording sheet defined between adjacent walls, or a single continuous wall extending in the width direction of the recording sheet, the plurality of walls and the single continuous wall being configured to extend in a whole area extending from the upper portion to the lower portion.

11. The image forming apparatus according to claim 7, wherein a plurality of contacting points between the upper portion of the guide member and the opened cover is arranged along a direction in which a pivot shaft of the guide member extends.

* * * * *